US006360573B1

(12) United States Patent
Ming-Chih

(10) Patent No.: US 6,360,573 B1
(45) Date of Patent: Mar. 26, 2002

(54) MECHANISM FOR LOCKING AND UNLOCKING ELECTRONIC SAFE LOCK BARREL

(75) Inventor: Chen Ming-Chih, Taichung (TW)

(73) Assignee: Summit Automation Co., Ltd, Taichung (TW)

( * ) Notice: Subject to any disclaimer, the term of this patent is extended or adjusted under 35 U.S.C. 154(b) by 0 days.

(21) Appl. No.: 09/659,122

(22) Filed: Sep. 11, 2000

(51) Int. Cl.[7] ..... E05B 47/00

(52) U.S. Cl. ..... 70/277; 70/256; 70/266; 70/275; 70/277; 70/278.1; 70/278.2; 70/278.3; 70/278.6; 70/279.1

(58) Field of Search ..... 70/277, 275, 266, 70/278.1, 278.6, 278.2, 278.3, 279.1, 256; 292/172

(56) References Cited

U.S. PATENT DOCUMENTS 2,823,536 A * 2/1958 Watson ..... 70/1.5
3,266,278 A * 8/1966 Ennitt ..... 70/277
3,559,430 A * 2/1971 Waller ..... 70/277
3,733,861 A * 5/1973 Lester ..... 70/153
4,671,086 A * 6/1987 Fogleman et al. ..... 70/277
4,745,784 A * 5/1988 Gartner ..... 70/277
5,010,751 A * 4/1991 Schwartz et al. ..... 70/276
5,487,289 A * 1/1996 Otto, III et al. ..... 70/279
5,542,274 A * 8/1996 Thordmark et al. ..... 70/495
5,813,257 A * 9/1998 Claghorn et al. ..... 70/208

* cited by examiner

*Primary Examiner*—B. Dayoan
*Assistant Examiner*—Carlos Lugo
(74) *Attorney, Agent, or Firm*—W. Wayne Liauh

(57) ABSTRACT

A mechanism for locking and unlocking an electronic safe lock barrel which is provided with a retaining long key and is fastened with a rotary mechanism located on the outside of the safe door. The lock barrel has a portion which is located in the inside of the safe door and is provided with a position confining slide sleeve. The position confining slide sleeve is fastened at the rear end with a motor having a rotary shaft which is engaged with a threaded sleeve capable of displacing back and forth. The threaded sleeve is provided with a retaining slot for retaining the retaining long key of the lock barrel so as to prevent the lock barrel from being turned by the rotary mechanism. The motor is operated by the circuit to enable the threaded sleeve to retain or release the retaining long key of the lock barrel, thereby controlling the locking and the unlocking mechanisms of the electronic lock.

8 Claims, 12 Drawing Sheets

MECHANISM FOR LOCKING AND UNLOCKING ELECTRONIC SAFE LOCK BARREL

FIELD OF THE INVENTION

The present invention relates generally to an electronic safe lock, and more particularly to a mechanism for working the lock barrel of the electronic safe lock.

BACKGROUND OF THE INVENTION

As shown in FIGS. 1 and 2, the conventional safe is provided with a key 2 and a lock 3 comprising an eccentrically-arranged rod 4 and a rotary disk 5 which is provided with an urging slot 6 in which the rod 4 is disposed. The rotary disk 5 is provided with two opposite retaining rods 7 and 8, which are fastened pivotally with the rotary disk 5. When the lock 3 is turned by the key 2, the rod 4 is actuated to rotate such that the rod 4 is displaced in the urging slot 6, and that the rotary disk 5 is urged by the rod 4 to turn, thereby causing the rotary disk 5 to actuate the two retaining rods 7 and 8 to move at the same time in the opposite directions. If the retaining rods 7 and 8 are jutted out, they are retained by a top frame 9 and a bottom frame 10. After the lock is unlocked by the key 2, the door 1 is opened. In the event that the key 2 is lost, the safe must be opened by a locksmith.

As shown in FIG. 3, another conventional safe 12 is provided with a plurality of combination locks, which work in conjunction with a key. The safe 12 may be burglarproof; nevertheless its use may result in various inconveniences similar in nature to those of the safe as described above with reference to FIGS. 1 and 2.

An electronic lock is disclosed by this inventor of the present invention in the U.S. patent apllication Ser. No. 09/431,682. As shown in FIG. 4, the electronic lock comprises a coil 20 which is used to bring about a magnetic force for attracting an action piece 21 to push an actuation block 22 to engage a retaining block 23. As the power supply is interrupted, action piece 22 returns to its original position, thereby resulting in the disengagement of the actuation block 22 with the retaining block 23. As a result, the retaining block 23 is not linked with a door handlebar 24. In other words, the power supply interruption results in an automatic locking state of the electronic lock. In the event that the doors of the safe are to be kept open, the electronic lock must be continuously provided with the power, so as to keep the handlebar 24 to be linked with the retaining block 23. It is therefore readily apparent that the electronic lock is not energy efficient, and that the electronic lock is more suitable for use in an automatic door or gate than a safe.

SUMMARY OF THE INVENTION

The primary objective of the present invention is to provide a novel electronic lock which is free of the drawbacks of the conventional locks described above.

In keeping with the principle of the present invention, the foregoing objective of the present invention is attained by the electronic lock comprising a lock barrel which is provided with a retaining long key for retaining a rotary mechanism of the lock barrel so as to rotate the lock barrel from the outside of the door. The lock barrel has a portion which is located in the inside of the door and is vertically disposed a position confining slide sleeve. The rear end of the slide sleeve is fastened with a motor having a rotary shaft which is provided with outer threads. A threaded sleeve which is engaged with the front end of the slide sleeve is fastened with the rotary shaft. As the motor is in operation, the threaded sleeve slides back and forth in the position confining slide sleeve. Before a safe is unlocked, the motor is electronically started by entering the code, thereby resulting in the disengagement of the threaded sleeve with the lock barrel. The lock barrel can be turned by the rotary mechanism. The safe is locked once again by entering the code, so as to cause the motor to drive the threaded sleeve to move forward to retain the lock barrel. As the rotary mechanism is turned, the lock barrel is retained by the threaded sleeve. The present invention can be operated with ease and speed without using a key. The electronic control of the present invention is burglarproof.

When the motor is no longer in operation, the threaded sleeve is fixed. As a result, in case of power outage or interruption, the electronic lock of the present invention remains in the unlocked state in view of the threaded sleeve being disengaged with the lock barrel. The present invention is thus energy efficient.

DETAILED DESCRIPTION OF THE INVENTION

Figure 1:
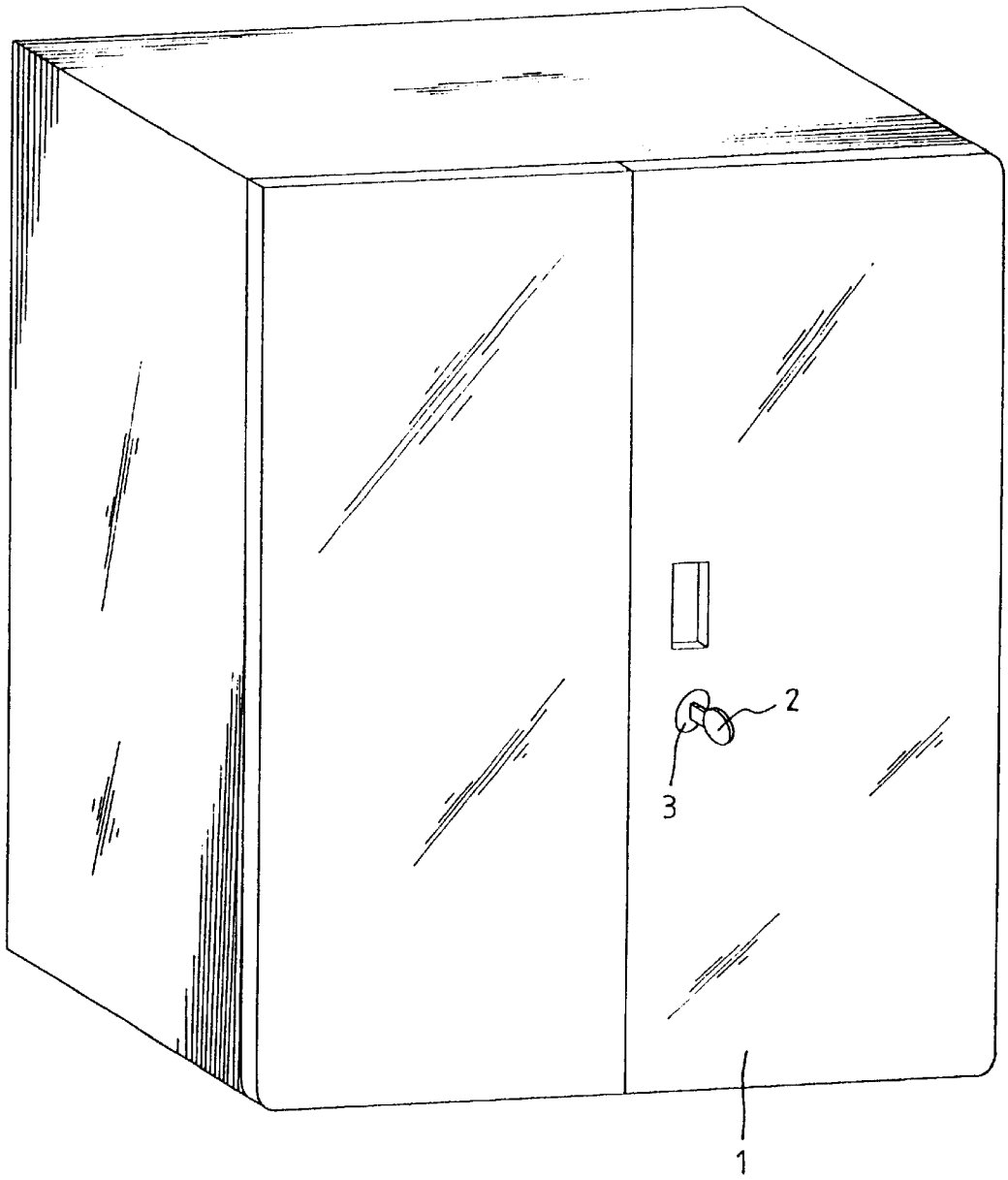
Fig. 1 PRIOR ART
FIG. 1 shows a schematic view of a prior art safe.
Figure 2:
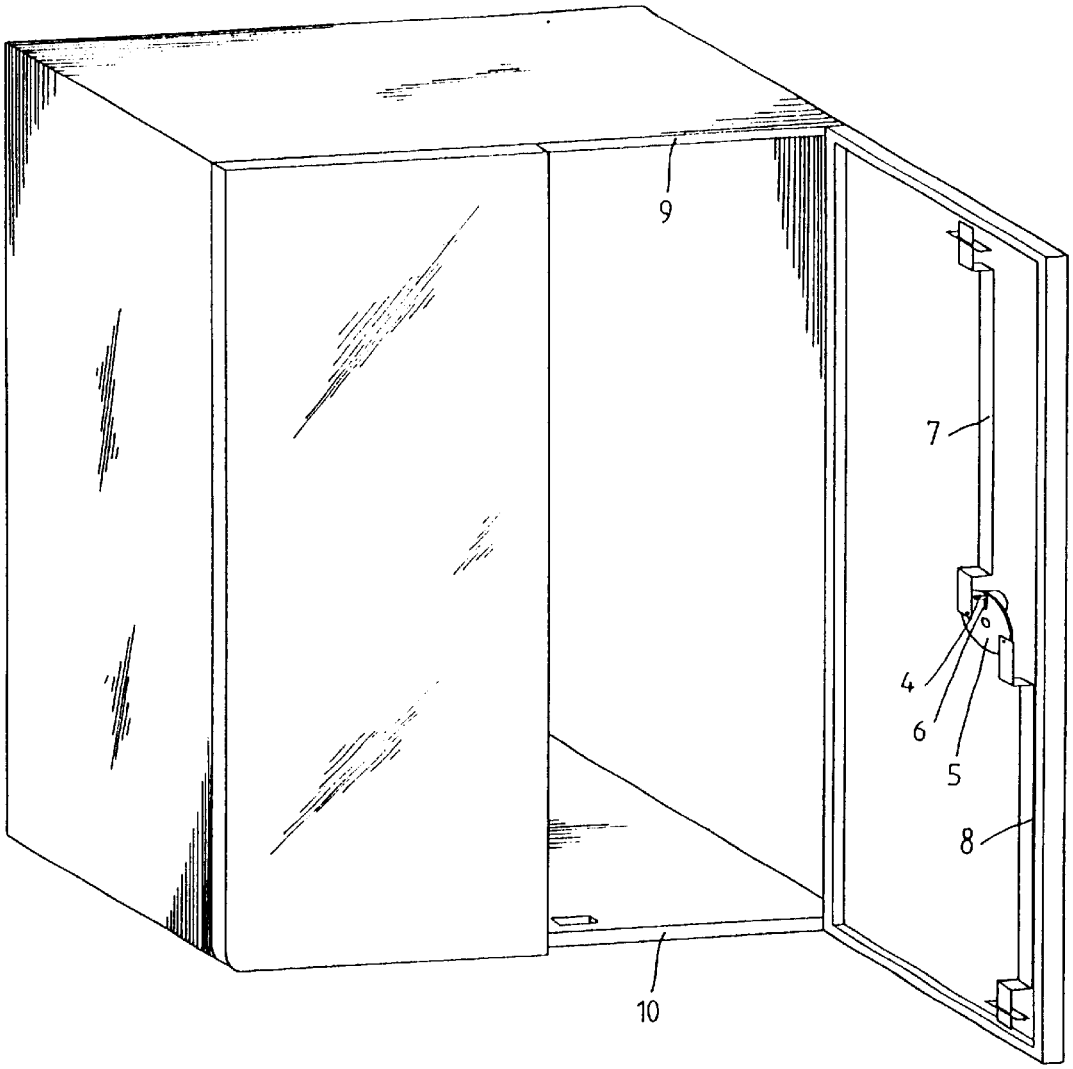
Fig. 2 PRIOR ART
FIG. 2 shows an internal schematic view of the prior art safe.
Figure 3:
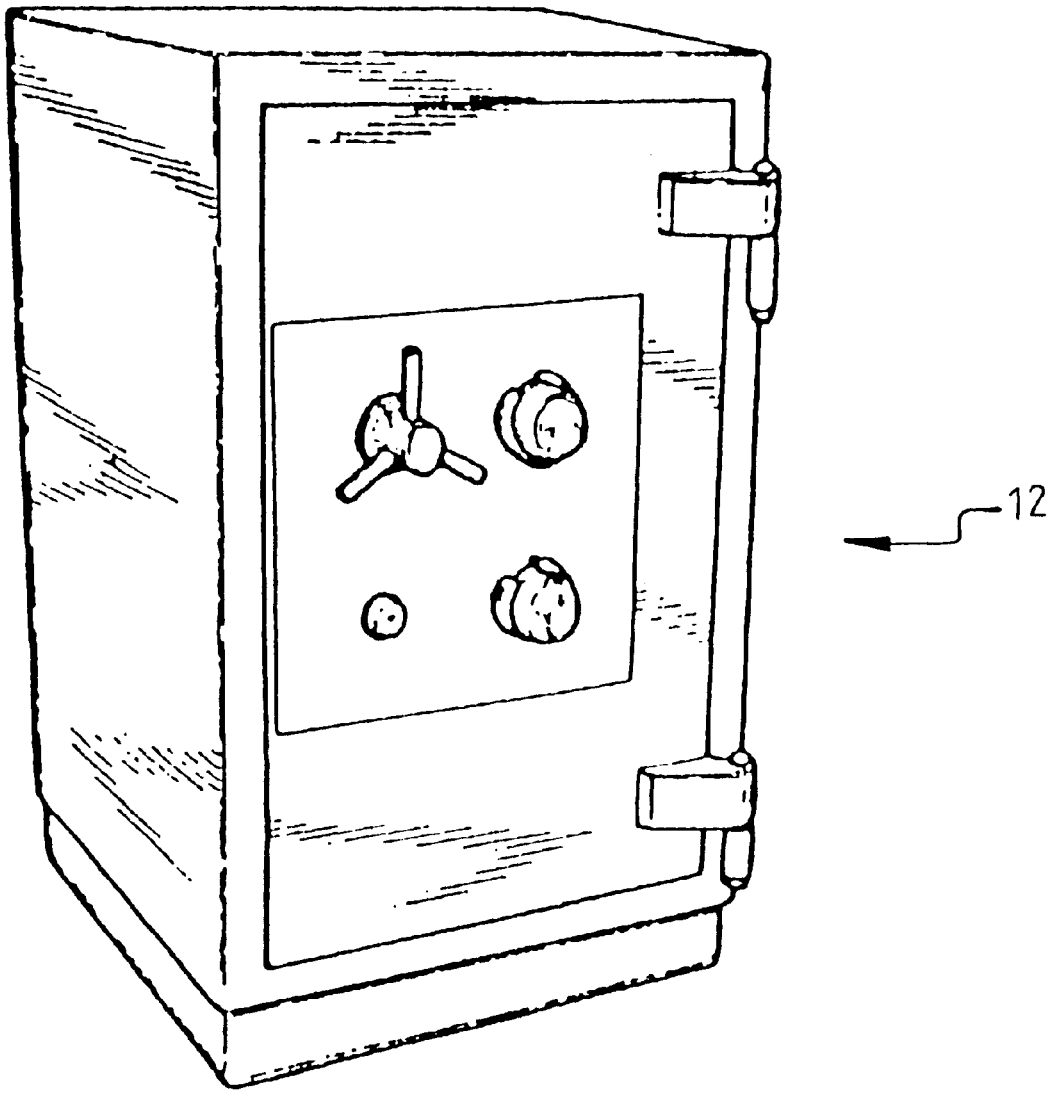
Fig. 3 PRIOR ART
FIG. 3 shows a schematic view of another prior art safe.
Figure 4:
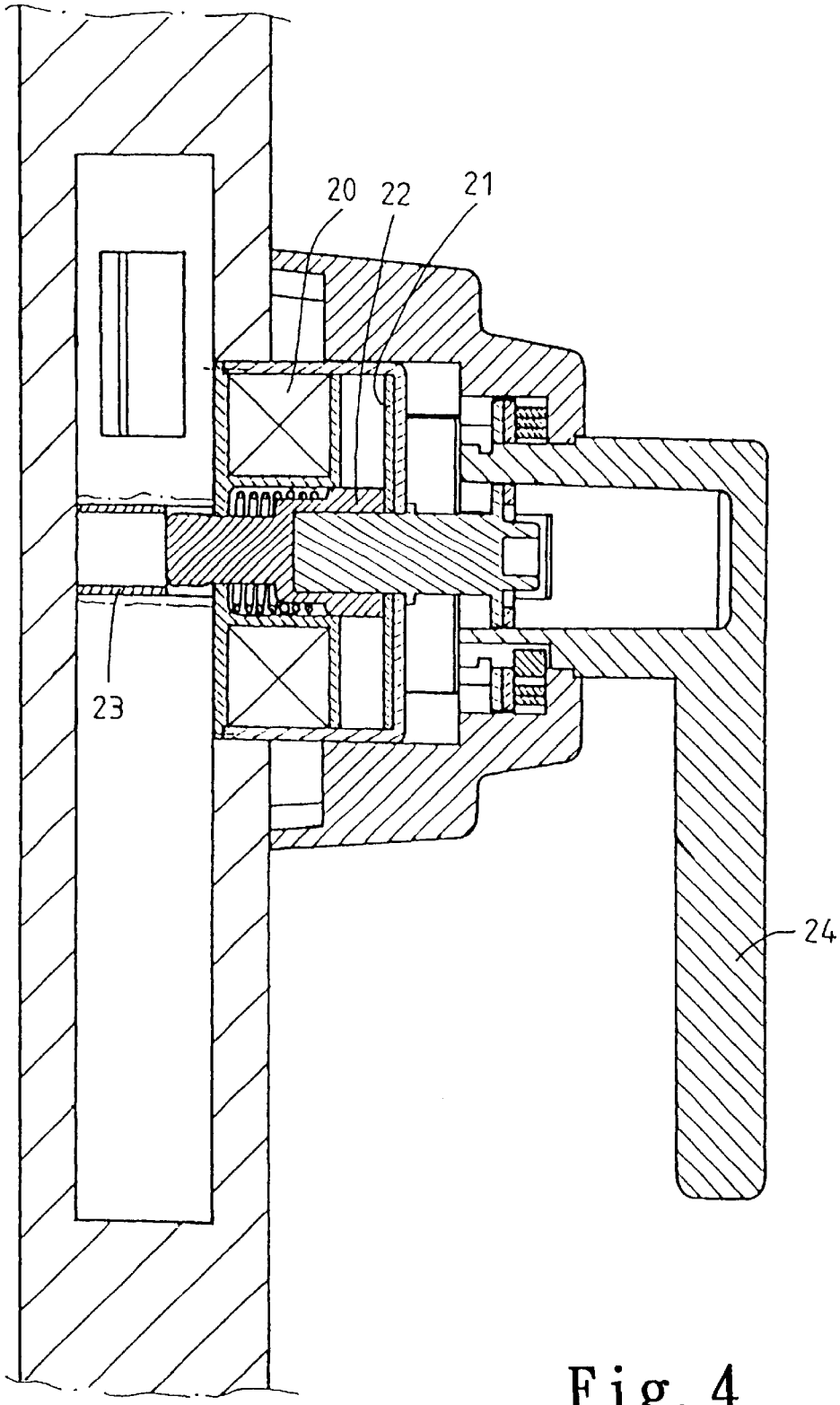
Fig. 4 PRIOR ART
FIG. 4 shows a schematic view of an electronic lock disclosed in the U.S. patent application Ser. No. 09/431,682.
Figure 5:
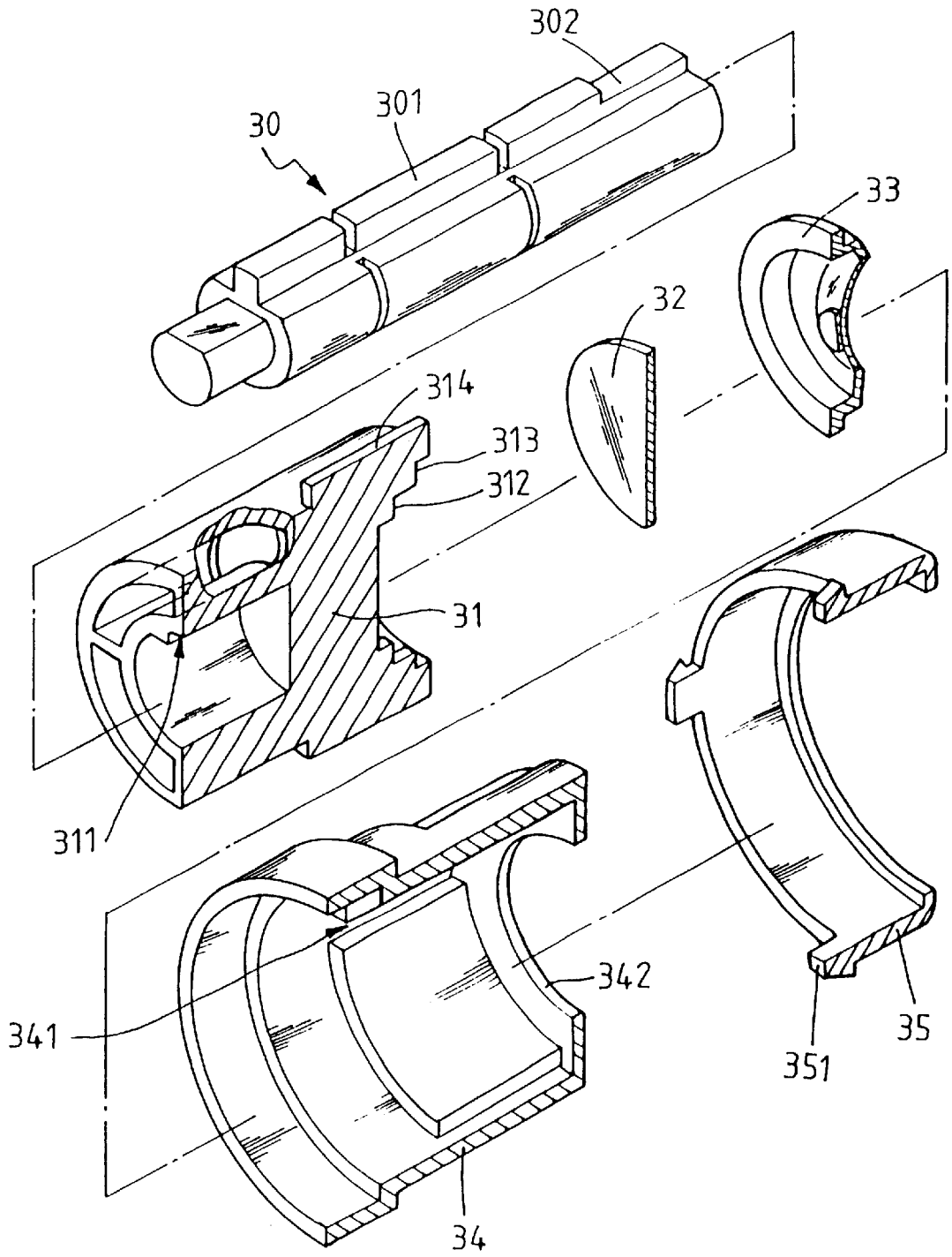
FIG. 5 shows an exploded view of the rotary mechanism of the present invention.
Figure 6:
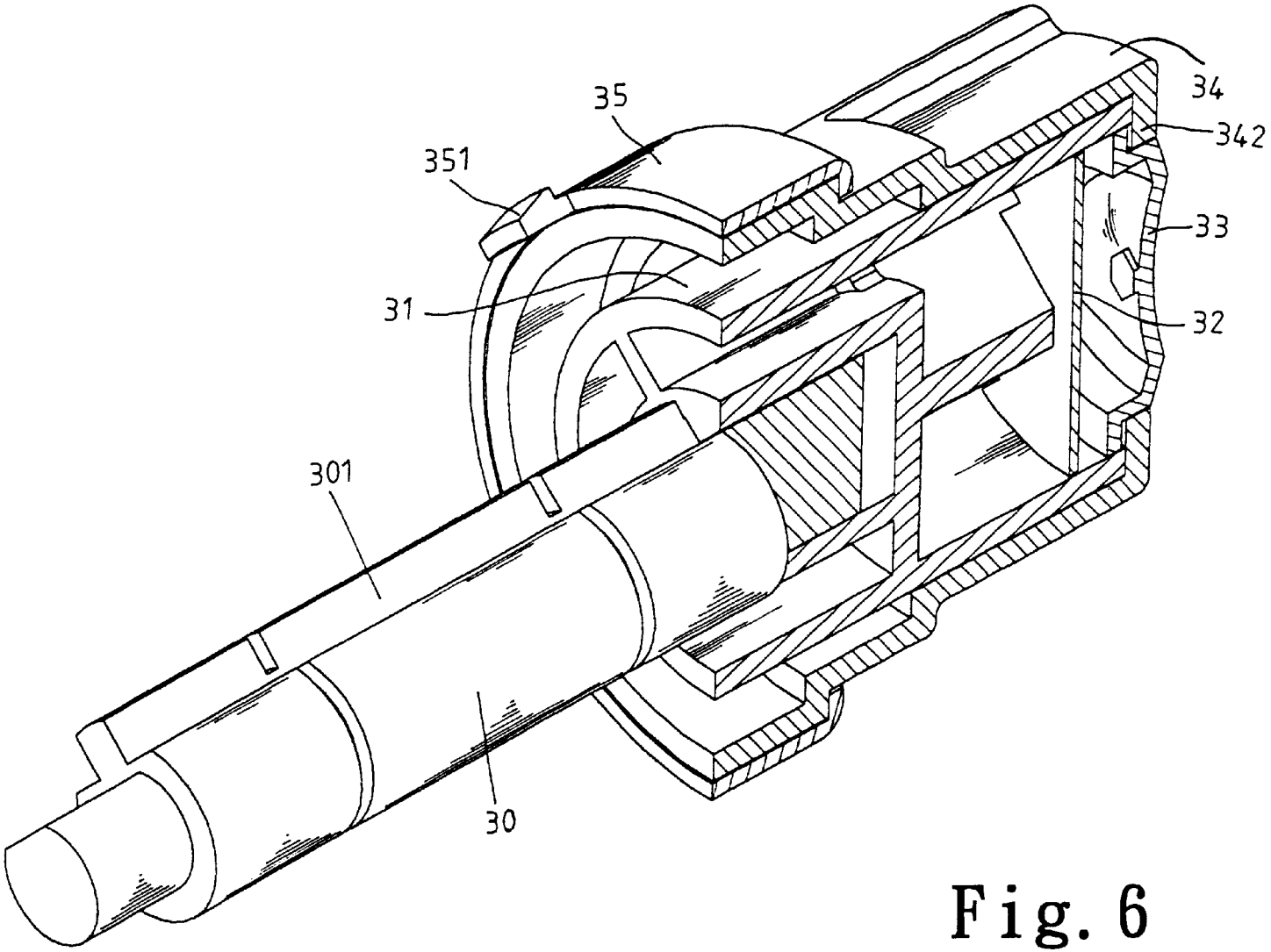
FIG.6 shows a sectional schematic view of the rotary mechanism of the present invention in combination.

As shown in FIGS. 5 and 6, a lock barrel 30 of the present invention is horizontally disposed through the door body and is provided with a retaining long key 301 of a stepped construction. The retaining key 301 is provided at one end with a retaining block 302. The lock barrel 30 has a portion which is located in the outside of the door body and is provided with a rotary mechanism comprising a lock barrel retaining sleeve 31 having a retaining slot 111 for retaining the retaining block 302. The retaining sleeve 31 further has stepped inner edges 312 and 313 for fastening a circuit board 32 and a protective cover 33. The retaining sleeve 31 still has a retaining pillar 314 and a handlebar rotating ring 34 having an insertion slot 341. As the handlebar rotating ring 34 is fitted over the lock barrel retaining sleeve 31, the retaining pillar 314 is retained in the insertion slot 341. The handlebar rotating ring 34 is provided at the front end with a stop piece 342, which presses against the protective cover 33, so as to enable the lock barrel 30, the lock barrel retaining sleeve 31, and the handlebar rotating ring 34 to be linked to prevent the disengagement of the lock barrel retaining sleeve 31 with the handlebar rotating ring 34. The handlebar rotating ring 34 is provided with a fixation ring 35 fitted thereover and provided a retainer 351 which is retained by the inner side of the door body. As a result, the lock barrel 30, the lock barrel retaining sleeve 31, and the handlebar rotating ring 34 are fixed on the outer side of the door body. The lock barrel 30 is actuated to turn by the handlebar rotating ring 34.

Figure 7:
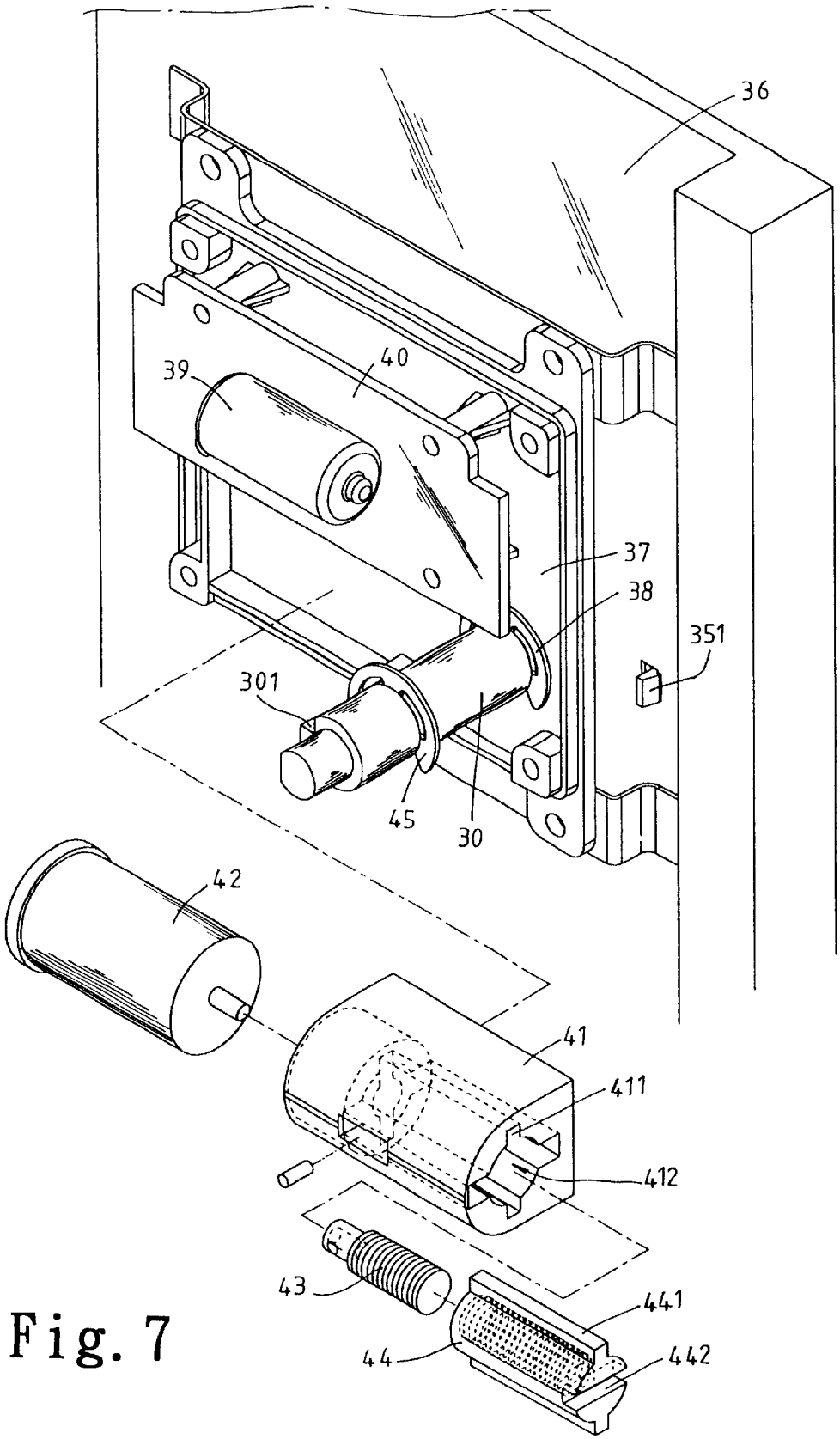
FIG. 7 shows an exploded view of the present invention.
Figure 8:
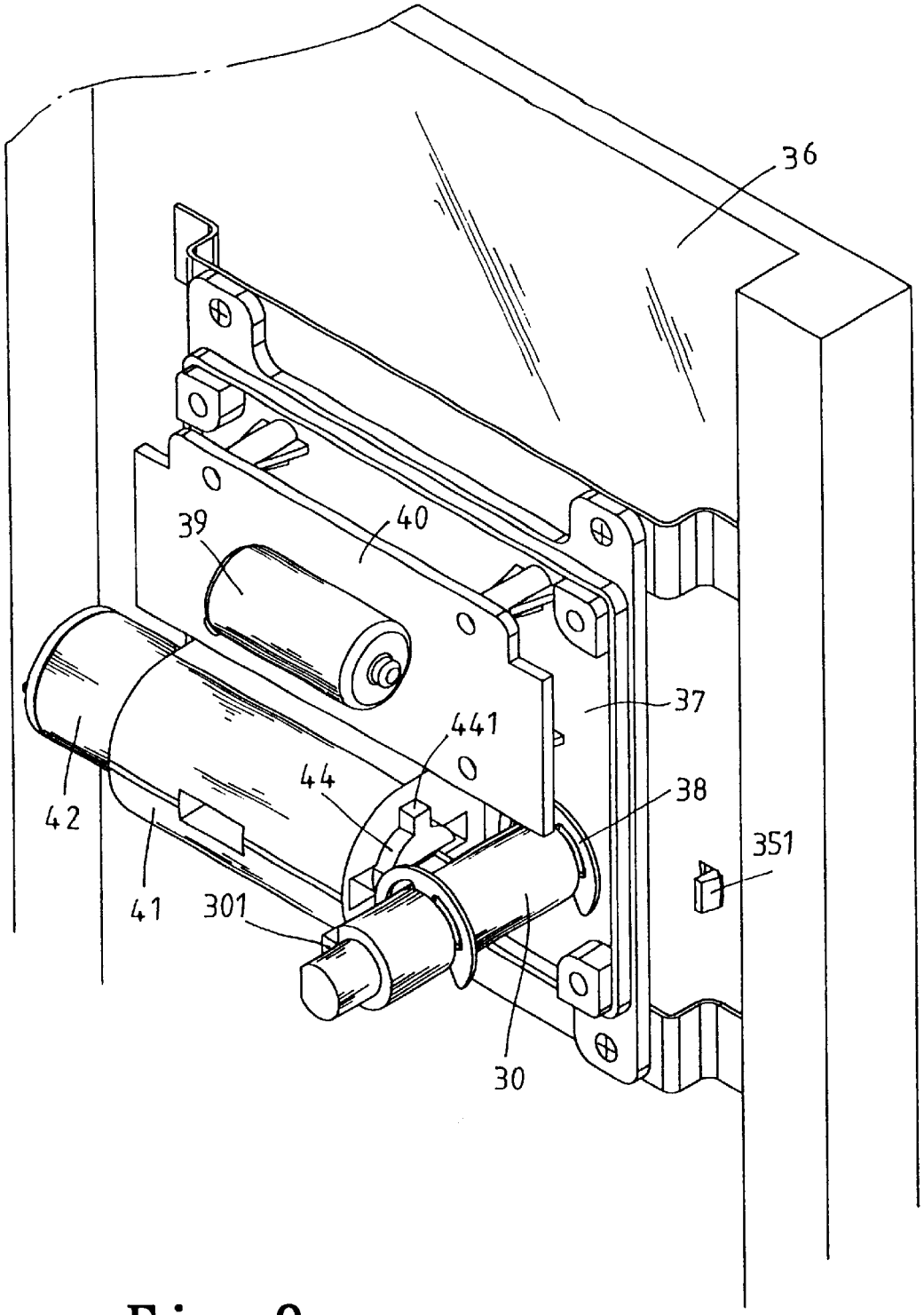
FIG. 8 shows a schematic view of the present invention in combination.

As shown in FIGS. 7 and 8, the lock barrel 30 is put through the door body 36 from the outer side of the door body such that the lock barrel 30 is put through a bottom seat 37. In order to prevent the lock barrel 30 from slipping out, and E-shaped retainer 38 is used to urge the bottom seat 37 on which a circuit board 40 and a position confining slide sleeve 41 are mounted such that the circuit board 40 is provided with battery 39, and that the position confining slide sleeve 41 is perpendicular to the lock barrel 30. The position confining slide sleeve 41 is fastened at one end thereof with a motor 42 having a rotary shaft which is connected with a threaded rod 43. A threaded sleeve 44 is provided with a retaining key 441 and a retaining slot 442. The threaded sleeve 44 is fitted into a fitting hole 412 of the position confining slide sleeve 41 such that the retaining key 441 is received in the fitting slot 411, and that the inner threads of the threaded sleeve 44 are meshed with the threaded rod 43. As the motor 42 is started, the threaded rod 43 turns. In light of the threaded sleeve 44 being confined by the retaining key 441 which is received in the fitting slot 411, the threaded sleeve 44 does not turn. However, the threaded sleeve 44 slides along the position confining slide sleeve 41 such that the retaining slot 442 retains the long key 301 of the lock barrel 30. As a result of the lock barrel 30 being retained by the threaded sleeve 44, the lock barrel 30 can not be turned.

Figure 9:
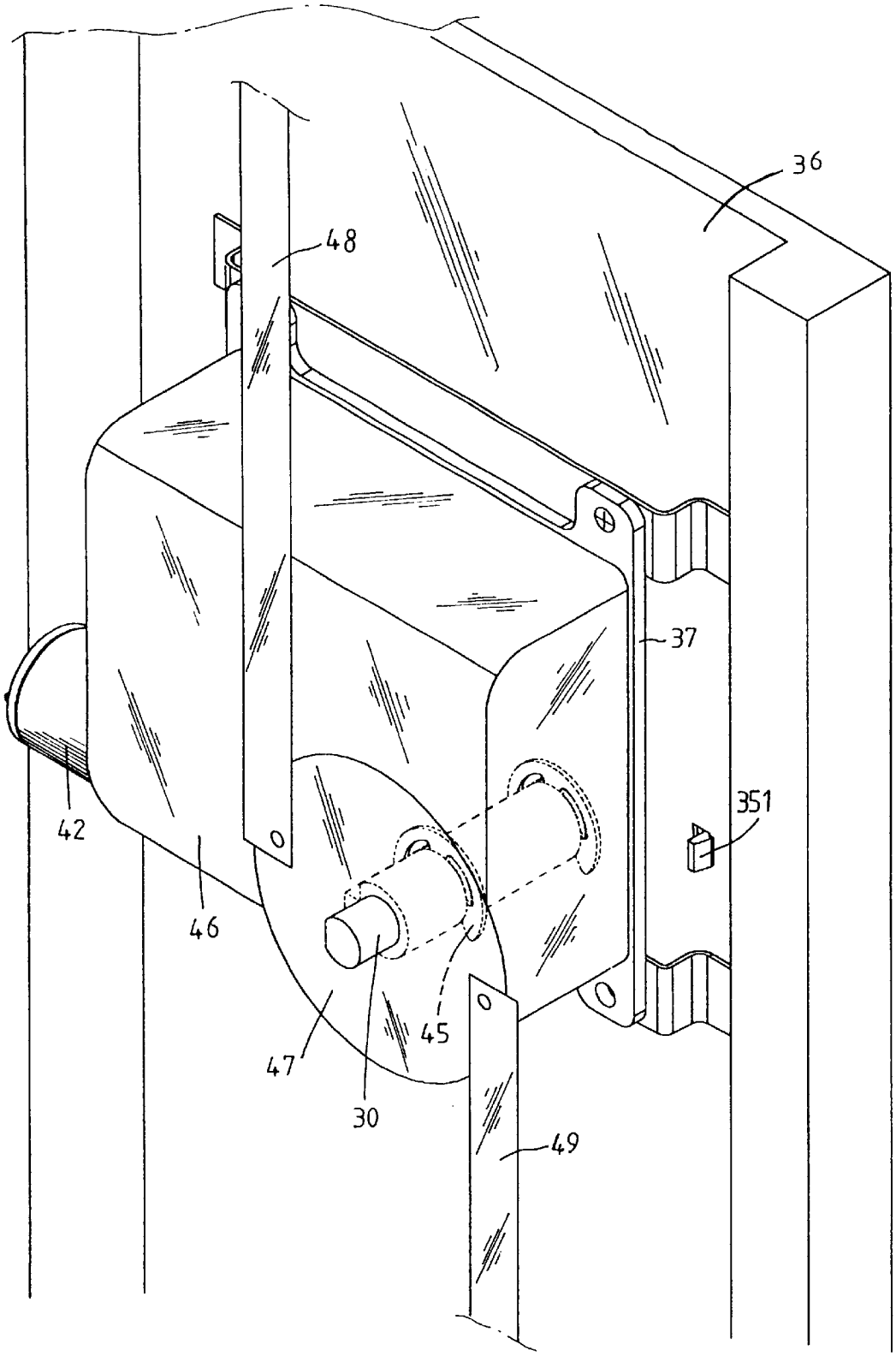
FIG. 9 shows a schematic view of the present invention in use.

As shown in FIG. 9, in order to prevent the lock barrel 30 from slipping out of the inner side of the door body 36, an E-shaped retainer 45 is used to press against the outer cover 46. The lock barrel 30 is jutted out of the outer cover 46 to fasten with a rotary disk 47 of the safe retaining mechanism and the door body. As a result, the rotary disk 47 can be actuated by the lock barrel 30 to turn, thereby causing two retaining rods 48 and 49 to retain the safe body.

Figure 10:
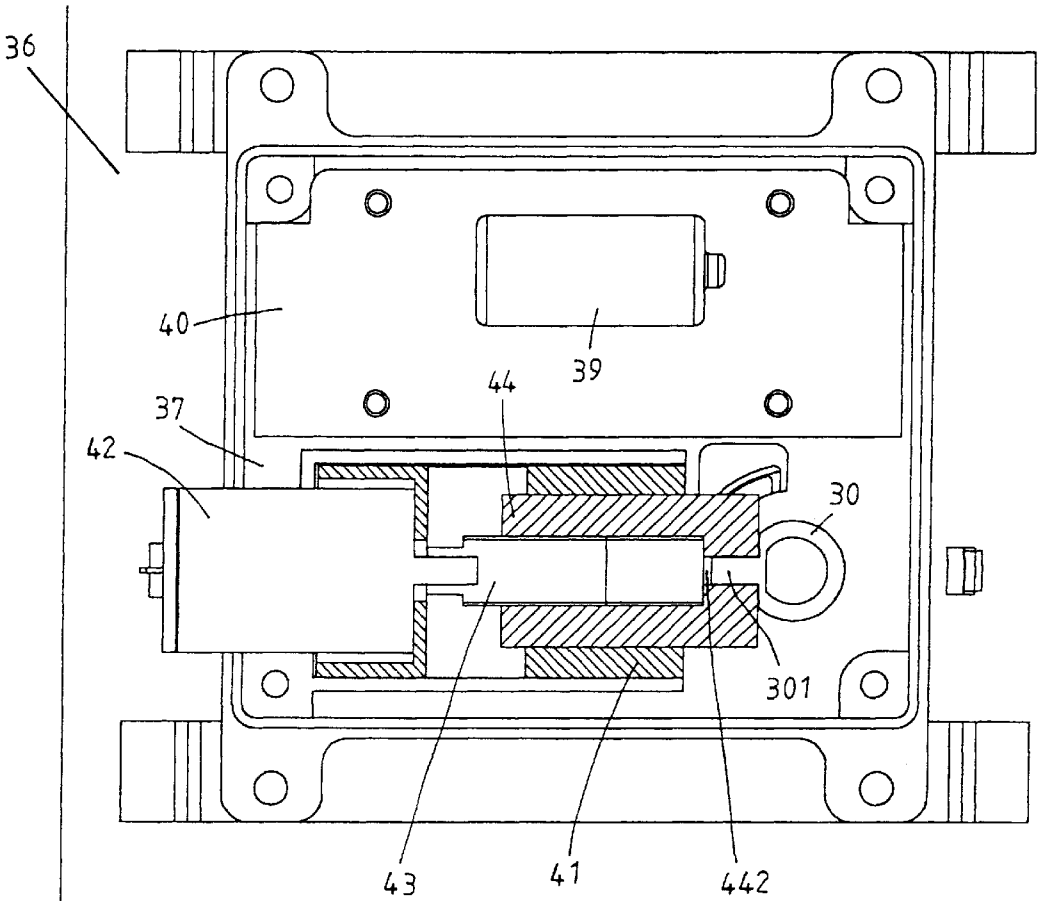
FIG. 10 shows a schematic view of the present invention in the locking state.

As shown in FIG. 10, when the present invention in the locking state, the threaded sleeve 44 is driven by the motor 42 to jut out of the position confining slide sleeve 41 such that the retaining slot 442 of the threaded sleeve 44 retains the long key 301 of the lock barrel 30. The retaining action is effected vertically, the lock barrel 30 can not be turned. As a result, the rotary mechanism can not be turned from the outer side of the door body 36. The locking state persists in the event that the power supply is interrupted.

Figure 11:
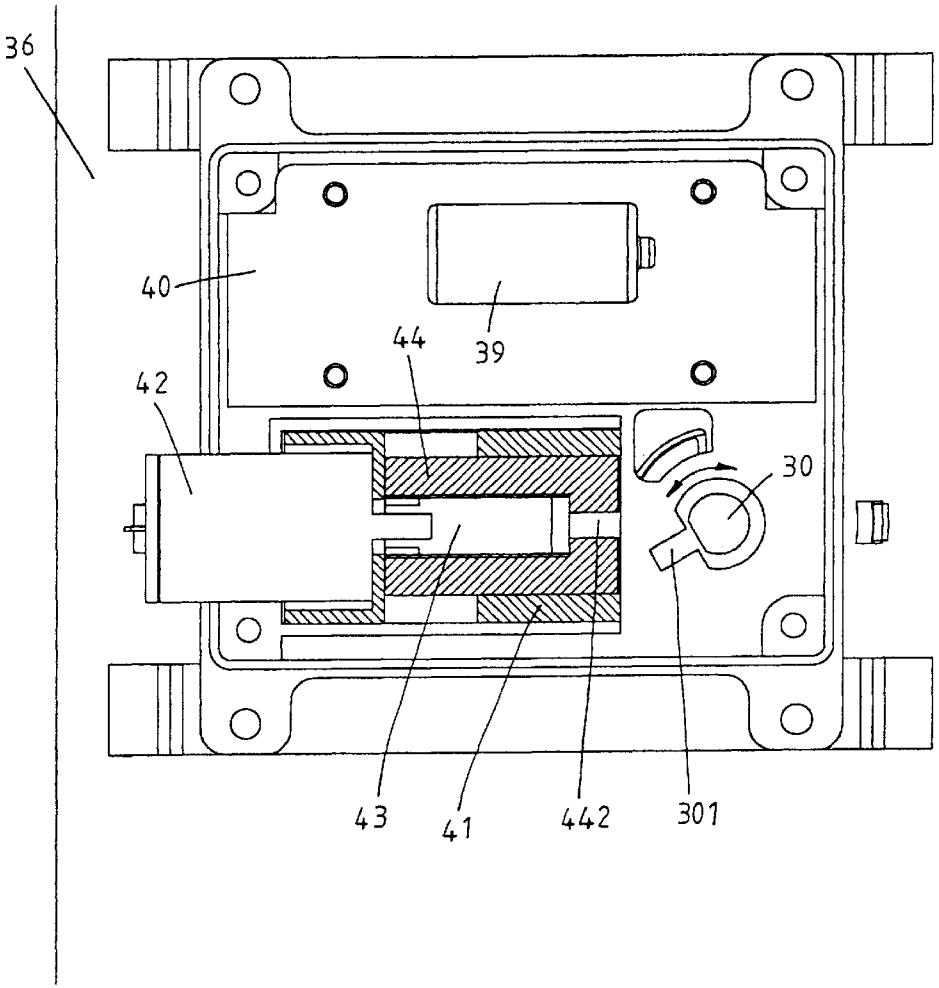
FIG. 11 shows a schematic view of the present invention in the unlocking state.

As shown in FIGS. 9 and 11, when the present invention is in the unlocking state, the threaded sleeve 44 is driven by the motor 42 to retract into the position confining slide sleeve 41 such that the retaining slot 442 is separated from the long key 301 of the lock barrel 30. As a result, the lock barrel 30 can be turned by the handlebar rotating ring. The rotary disk 47 can be actuated to turn such that the retaining rods 48 and 49 retract to allow the door body to be opened. When the present invention remains in the unlocking state, the threaded sleeve 44 remains separated from the lock barrel 30 even in the event of the power supply interruption.

Figure 12:
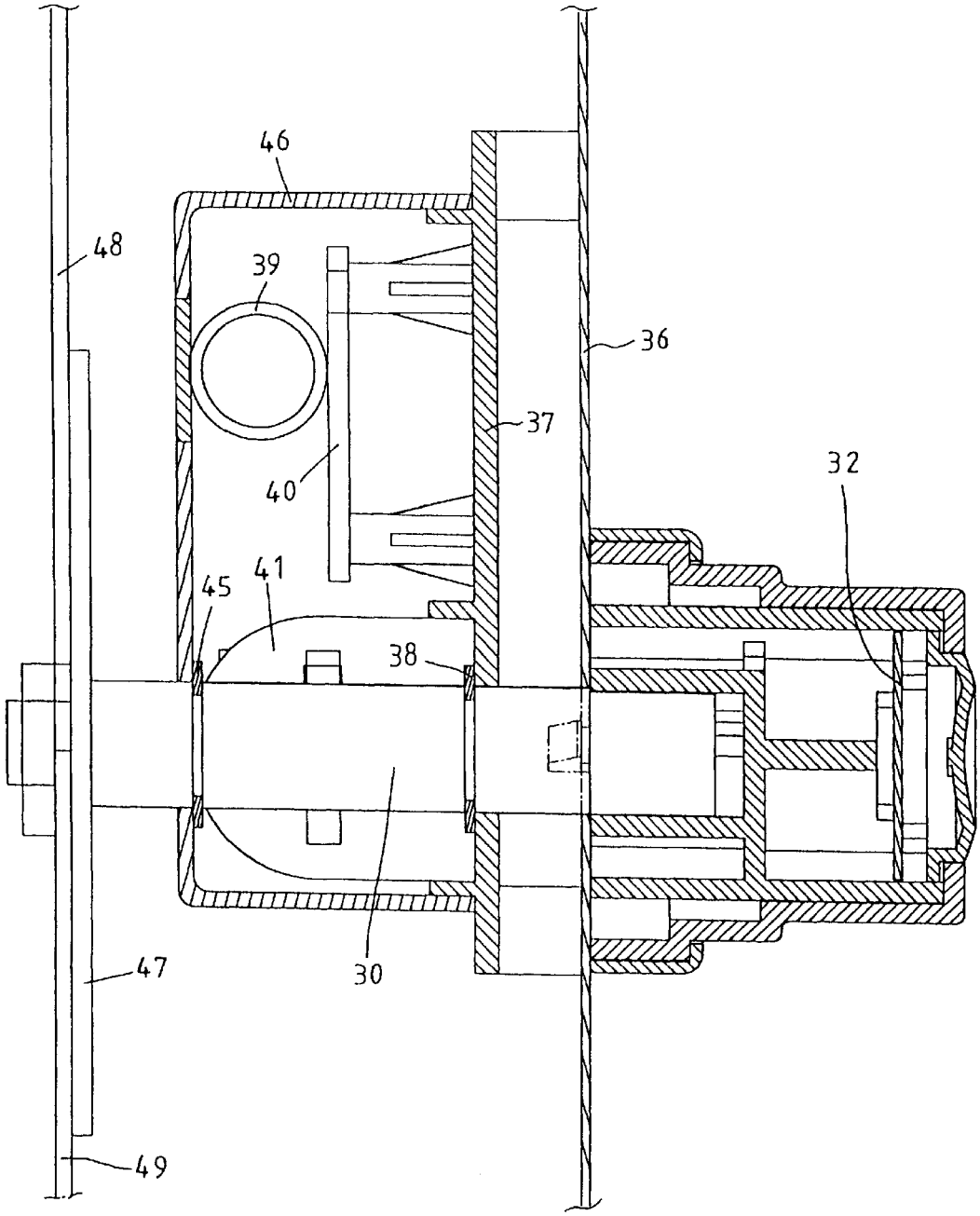
FIG. 12 shows a schematic view of the present invention at work.

As shown in FIG. 12, the operation of the present invention calls for an operator to enter in the outer side of the door body 36 the encode-decode, such as the password, the sensor, the remote controller, etc., which are received by the circuit board 32 and are then transmitted to another circuit board 40 so as to start the motor to unlock the electronic lock of the present invention.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A mechanism for locking and unlocking an electronic lock barrel, said mechanism comprising:

a lock barrel provided with a retaining long key and disposed horizontally across a safe door, said lock barrel having a portion which is located outside the safe door and is provided with a rotary mechanism fastened therewith;

a bottom seat fastened with the inner side of the safe door such that said bottom seat retains said lock barrel;

a position confining slide sleeve fastened with said bottom seat such that said position confining slide sleeve is perpendicular to said lock barrel, said position confining slide sleeve being fastened at a rear end with a motor having a rotary shaft which is provided with a threaded portion, sand position confining slide sleeve being provided at a front end with a fitting hole;

a threaded sleeve having a body which is provided with inner threads, said threaded sleeve being engaged with said fitting hole of said position confining slide sleeve such that said inner threads are meshed with said threaded portion of said rotary shaft of said motor, said threaded sleeve provided at a front end with a retaining slot corresponding to aid retaining long key of said lock barrel; and an outer cover fastened with said bottom seat such that said lock barrel is jutted out of said outer cover to engage a retaining mechanism of the safe door and the safe body.

2. The mechanism as defined in claim 1, wherein said rotary mechanism comprises:

a lock barrel retaining sleeve provided in an inner hole of a rear end thereof with a retaining slot in which said retaining long key of said lock barrel is retained, said lock barrel retaining sleeve further provided at a front end thereof with a retaining pillar and in an inner hole of the front end with a stepped inner edge for fastening a circuit board and a protective cover whereby said circuit board receives encode-decode entered externally;

a handlebar rotating ring having a stepped inner hole which is provided with an insertion slot for retaining said retaining pillar of said lock barrel retaining sleeve, said handlebar rotating ring being fitted over said lock barrel retaining sleeve such that a stop piece of said handlebar rotating ring presses against said protective cover; and a fixation ring fitted over said handlebar rotating ring and provided with a plurality of retainers for catching the safe door.

3. The mechanism as defined in claim 1, wherein said retaining mechanism is provided with a rotary disk which is fastened with said lock barrel and is provided with two retaining rod fastened pivotally thereto whereby said rotary disk is actuated by said lock barrel to cause said retaining rods to open or close the safe door.

4. The mechanism as defined in claim 1, wherein said bottom seat is fastened with said lock barrel in conjunction with an E-shaped retainer whereby said retainer is fitted over said lock barrel such that said retainer urges said bottom seat, so as to prevent said lock barrel from slipping out of the safe door.

5. The mechanism as defined in claim 1, wherein said fitting hole of said position confining slide sleeve is provided with a fitting slot; wherein said threaded sleeve is provided with a retaining key and is fitted into said position confining slide sleeve such that said retaining key is inserted into said fitting slot, and that said threaded sleeve is meshed with said threaded portion of said rotary shat of said motor.

6. The mechanism as defined in claim 1, wherein said rotary shaft of said motor is provided with a threaded rod fastened therewith such that said threaded rod is engaged with inner threads of said threaded sleeve.

7. The mechanism as defined in claim 1, wherein said said outer cover is fastened with said bottom seat via said lock barrel in conjunction with an E-shaped retainer which is retained on said lock barrel such that said retainer presses against said outer cover to prevent said lock barrel from slipping into the inner side of the safe door.

8. The mechanism as defined in claim 1, wherein said bottom seat is provided with a circuit board and a battery seat for controlling the operation of said motor.

* * * * *